US006837276B2

(12) United States Patent
Josef et al.

(10) Patent No.: US 6,837,276 B2
(45) Date of Patent: Jan. 4, 2005

(54) AIR CHANNEL DRYER FABRIC

(75) Inventors: Michael J. Josef, Clifton Park, NY (US); Rick Barbery, Columbia, SC (US)

(73) Assignee: Albany International Corp., Albany, NY (US)

( * ) Notice: Subject to any disclaimer, the term of this patent is extended or adjusted under 35 U.S.C. 154(b) by 233 days.

(21) Appl. No.: 10/289,989

(22) Filed: Nov. 7, 2002

(65) Prior Publication Data

US 2004/0089364 A1 May 13, 2004

(51) Int. Cl.[7] ..... D03D 15/00

(52) U.S. Cl. ..... 139/383 A; 139/383 AA; 139/426 R; 442/217

(58) Field of Search ..... 139/383 A, 383 AA, 139/426 R; 442/217; 162/348

(56) References Cited

U.S. PATENT DOCUMENTS

| | | | | |
|---|---|---|---|---|
| 4,283,454 A | | 8/1981 | Buchanan | |
| 5,169,499 A | | 12/1992 | Eagles et al. | |
| 5,503,196 A | | 4/1996 | Josef et al. | |
| 6,276,402 B1 | * | 8/2001 | Herring | 139/383 A |
| 6,354,335 B1 | * | 3/2002 | Taipale et al. | 139/383 A |
| 6,413,377 B1 | * | 7/2002 | Wright | 139/383 A |
| 6,427,728 B1 | * | 8/2002 | Maguire et al. | 139/383 A |
| 6,585,006 B1 | * | 7/2003 | Wilson et al. | 139/383 A |
| 6,649,026 B2 | * | 11/2003 | Lamb | 162/348 |
| 6,745,797 B2 | * | 6/2004 | Troughton | 139/383 A |
| 6,763,855 B2 | * | 7/2004 | Rougvie | 139/383 A |

FOREIGN PATENT DOCUMENTS

GB 2 292 755 A 3/1996

* cited by examiner

*Primary Examiner*—John J. Calvert
*Assistant Examiner*—Robert H. Muromoto, Jr.
(74) *Attorney, Agent, or Firm*—Frommer Lawrence & Haug LLP; Ronald R. Santucci

(57) ABSTRACT

A papermaker's fabric, usable with a dryer section on a paper machine, has a first layer and a second layer of cross-machine-direction (CD) yarns. Interwoven with the CD yarns in a duplex weave is a system of MD yarns. The MD yarns are provided in groups of at least two adjacent MD yarns. Each group has one first MD yarn and one or more second MD yarn. The first MD yarn interweaves between the first and second layers of CD yarns, each time binding with only one CD yarn. Each second MD yarn also interweaves between first and second layers of CD yarns, each time binding with only one CD yarn in the first layer, but floating over at least two CD yarns in the second layer. The first MD yarn is between the one or more second MD yarns in its group and those of an adjacent group, and defines a continuous air channel on the surface of the fabric.

11 Claims, 6 Drawing Sheets

AIR CHANNEL DRYER FABRIC

BACKGROUND OF THE INVENTION

The present invention relates to the papermaking arts. More specifically, the present invention is a papermaker's or dryer fabric for use on the dryer section of a paper machine, such as on a single-run dryer section.

During the papermaking process, a fibrous web is formed by depositing a fibrous slurry on a forming fabric in the forming section of a paper machine. A large amount of water drains from the slurry through the forming fabric, leaving the fibrous web on the surface thereof.

The newly formed web proceeds from the forming section to a press section, which includes a series of press nips. The fibrous web passes through the press nips supported by a press fabric, or, as is often the case, between two press fabrics. In the press nips, the fibrous web is subjected to compressive forces which squeeze water therefrom. This water is accepted by the press fabric or fabrics and, ideally, does not return to the web.

The web, by now a sheet, finally proceeds to a dryer section, which includes at least one series of rotatable dryer drums or cylinders which are heated from within by steam. The sheet is directed in a serpentine path sequentially around each in the series of drums by one or more dryer fabrics, which hold it closely against the surfaces of the drums. The heated drums reduce the water content of the sheet to a desirable level through evaporation.

In a dryer section, the dryer cylinders may be arranged in a top and a bottom row or tier. Those in the bottom tier are staggered relative to those in the top tier, rather than being in a strict vertical relationship. As the sheet proceeds through the dryer section, it passes alternately between the top and bottom tiers as it passes first around a dryer cylinder in one of the two tiers, then around a dryer cylinder in the other tier, and so on sequentially through the dryer section.

As shown in FIG. 5, in dryer sections, the top and bottom tiers of dryer cylinders may each be clothed with a separate dryer fabric 99. In such a situation, paper sheet 98 being dried passes unsupported across the space, or "pocket", between each dryer cylinder and the next dryer cylinder on the other tier.

In a single tier dryer section, a single row of cylinders along with a number of turning cylinders or rolls may be used. The turning rolls may be solid or vented.

In order to increase production rates and to minimize disturbance to the sheet, single-run dryer sections are used to transport the sheet being dried at high speeds. In a single-run dryer section, such as that shown in FIG. 6, a paper sheet 198 is transported by use of a single dryer fabric 199 which follows a serpentine path sequentially about dryer cylinders 200 in the top and bottom tiers.

It will be appreciated that, in a single-run dryer section, the dryer fabric holds the paper sheet being dried directly against the dryer cylinders in one of the two tiers, typically the top tier, but carries it around the dryer cylinders in the bottom tier. The fabric return run is above the top dryer cylinders. On the other hand, some single-run dryer sections have the opposite configuration in which the dryer fabric holds the paper sheet directly against the dryer cylinders in the bottom tier, but carries it around the top cylinders. In this case, the fabric return run is below the bottom tier of cylinders. In either case, a compression wedge is formed by air carried along by the backside surface of the moving dryer fabric in the narrowing space where the moving dryer fabric approaches a dryer cylinder. The resulting increase in air pressure in the compression wedge causes air to flow outwardly through the dryer fabric. This air flow, in turn, forces the paper sheet away from the surface of the dryer fabric, a phenomenon known as "drop off". "Drop off" can reduce the quality of the paper product being manufactured by causing edge cracks. "Drop off" can also reduce machine efficiency if it leads to sheet breaks.

Many paper mills have addressed this problem by machining grooves into the dryer cylinders or rolls or by adding a vacuum source to those dryer rolls. Both of these expedients allow the air otherwise trapped in the compression wedge to be removed without passing through the dryer fabric, although both are expensive.

The present invention provides a solution to this problem in the form of a dryer fabric having void volume on the surface which does not come into contact with the paper web, that is, on the backside surface. The void volume gives the air carried into the compression wedge somewhere to go other than through the fabric.

SUMMARY OF THE INVENTION

Accordingly, the present invention is a dryer fabric, although it may find application in any of the forming, press and dryer sections of a paper machine.

The papermaker's fabric includes a first layer and a second layer of cross-machine-direction (CD) yarns. Interwoven with the CD yarns is a system of machinedirection (MD) yarns.

The MD yarns are provided in groups of at least two adjacent MD yarns. Each group has a first MD yarn and at least one second MD yarn.

The first MD yarn in each group is interwoven with the CD yarns of the first and second layers in a duplex weave, binding with only one CD yarn of the first layer and with only one CD yarn of the second layer when so interweaving.

The second MD yarn or yarns in each group is also interwoven with the CD yarns of the first and second layers in a duplex weave. When a group includes more than one second MD yarn, they weave with the CD yarns side by side as one yarn. The second MD yarn or yarns bind with only one CD yarn of the first layer when interweaving therewith, but float over at least two consecutive CD yarns of the second layer when interweaving therewith.

The first MD yarn in each group is between the one or more second MD yarns in the same group and a second MD yarn of an adjacent group. As such, the first MD yarns form continuous air channels between second MD yarns separated by them.

The fabric is disposed on the dryer section in endless form, such that the continuous air channels reside on the inner, or back-side, surface thereof. The continuous air channels provide void volume for air carried into the compression wedge formed between the fabric and a dryer cylinder when the fabric is used on a dryer section such as a single-run dryer section.

The present invention will now be described in more complete detail with frequent reference being made to the drawing figures, which are identified below.

DETAILED DESCRIPTION OF THE PREFERRED EMBODIMENTS

Figure 1:
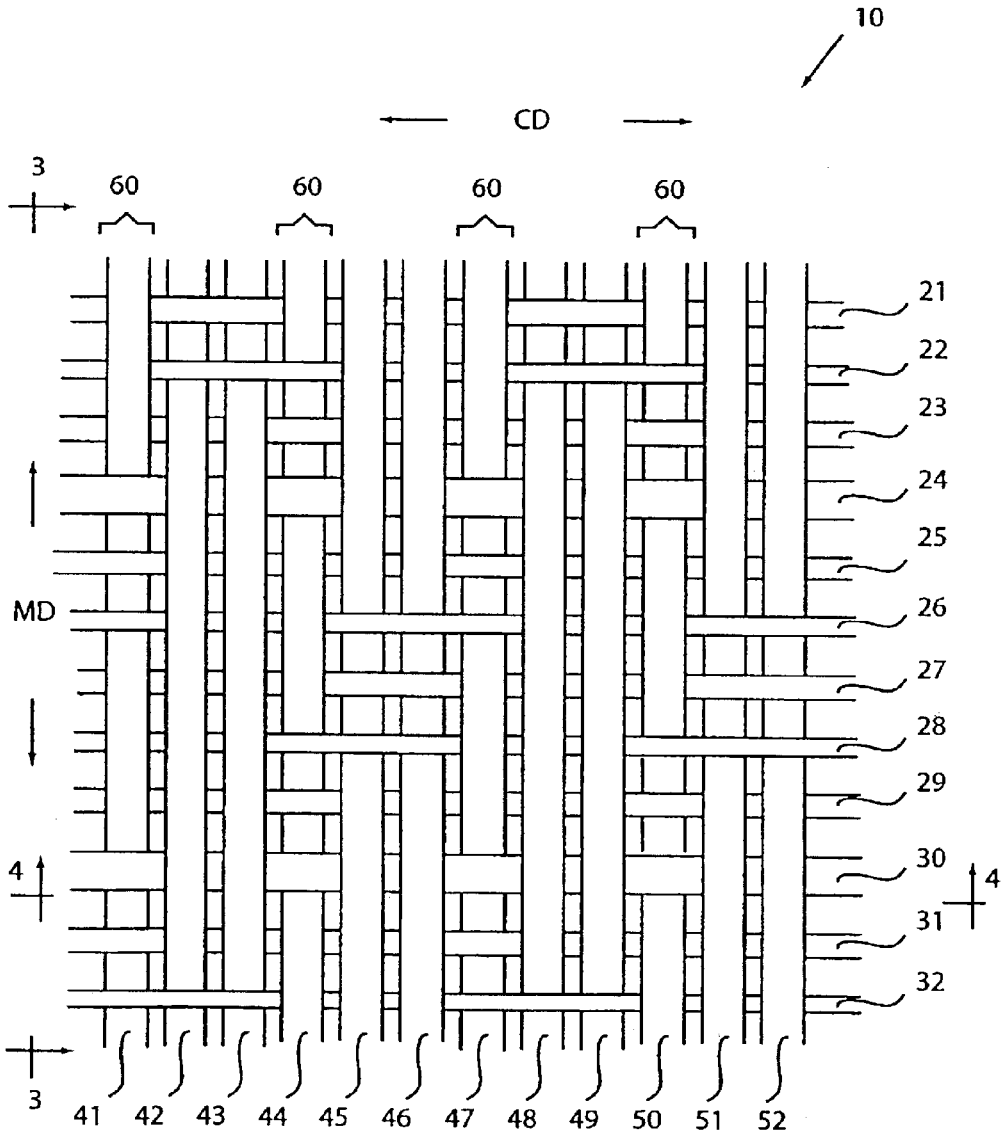
FIG. 1 is a plan view of the back-side surface of a papermaker's fabric according to an embodiment of the present invention.

With reference now to these figures, FIG. 1 is a plan view of the back-side surface 12 of the papermaker's fabric 10 of the present invention. In FIG. 1, the machine direction (MD) and cross-machine direction (CD) are as indicated. The spacing between the yarns of the papermaker's fabric 10 in this and other figures is exaggerated for the sake of clarity. FIG. 1 shows two repeats of the weave pattern side by side one another.

Figure 3A:
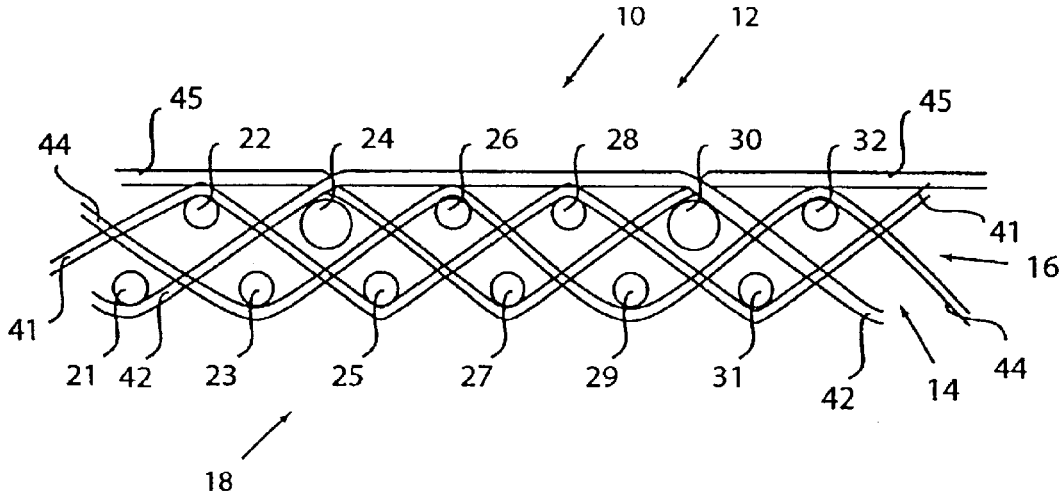
FIG. 3A is a cross-sectional view taken in the warpwise direction as indicated by line 3—3 in FIG. 1.

FIG. 3A is a cross-sectional view, taken as indicated by line 3—3 in FIG. 1. It will be observed that fabric 10 includes two layers of CD yarns. As fabric 10 may be flat woven and subsequently joined into endless form with a seam, the CD yarns are weft, or filling, yarns in the process by which fabric 10 is produced. A first layer 14 of CD yarns includes CD yarns 21,23,25,27,29,31, while a second layer 16 of CD yarns includes CD yarns 22,24,26,28,30,32. As is apparent in FIGS. 1 and 3A, the CD yarns in the two layers 14,16 are not in vertically stacked positions. Rather they alternate with one another in machine direction of the fabric 10, so that both layers are visible in the view presented in FIG. 1. In reality, CD yarns 21,23,25,27,29,31 of the first layer 14 may barely be visible on the back-side surface 12 of the actual fabric 10 as the spacing between the yarns is quite small.

Figure 4:
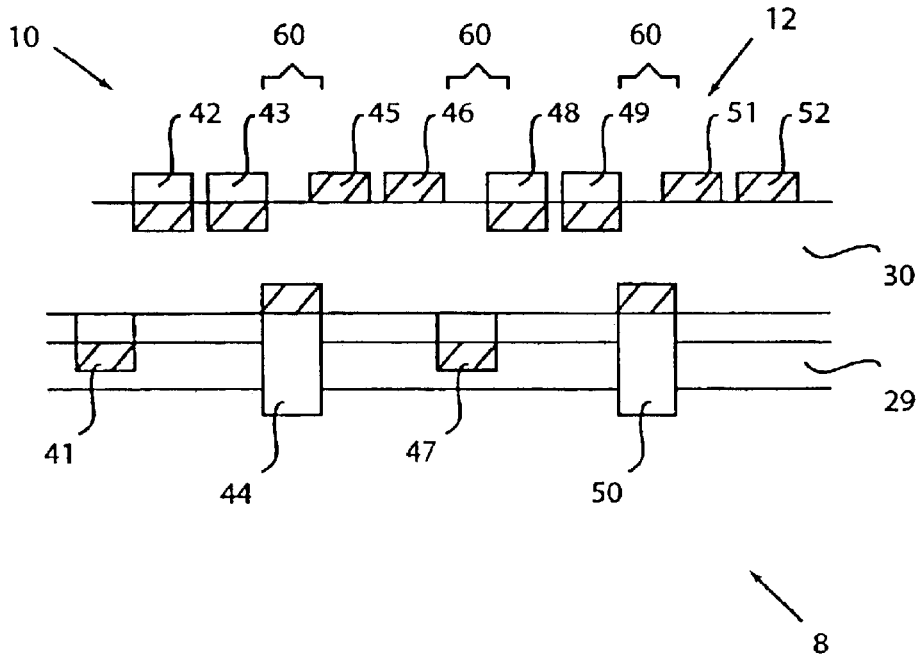
FIG. 4 is a cross-sectional view taken in the weftwise direction as indicated by line 4—4 in FIG. 1.

Returning now to FIG. 1, MD yarns 41–52, which are warp yarns in the process by which the fabric is woven, may be flat monofilament yarns having cross sections of substantially rectangular shape. The cross-sectional shape of MD yarns 41–52 is shown in FIG. 4, a cross-sectional view taken in the weftwise direction as indicted by line 4—4 in FIG. 1.

MD yarns 41–52 are arranged in groups of three in which two MD yarns are twinned and weave as one with the CD yarns 21–32. Specifically, MD yarns 42,43; MD yarns 45,46; MD yarns 48,49; and MD yarns 51,52 are twinned pairs, which are separated from those adjacent thereto by MD yarns 41,44,47,50. These latter MD yarns 41,44,47,50 define continuous air channels 60 on the back-side surface 12 of the fabric 10 in a manner to be described below.

The twinned MD yarn pairs form long floats on the back-side surface 12 of the fabric 10. Specifically, MD yarns 42,43 weave under CD yarns 21 and CD yarns 22, over CD yarns 23–31, and under CD yarns 32 in each repeat of the weave pattern, whereby MD yarns 42,43 float over four consecutive CD yarns 24,26,28,30 of the second layer 16 on the back-side surface 12 of the fabric 10. MD yarns 48,49 weave in the same manner as MD yarns 42,43.

Similarly, MD yarns 45,46 weave over CD yarns 21–25, under CD yarns 26–28, and over CD yarns 29–32 in each repeat of the weave pattern, whereby MD yarns 45,46 float over four consecutive CD yarns 30,32,22,24 of the second layer 16 on the back-side surface 12 of the fabric 10. MD yarns 51,52 weave in the same manner as MD yarns 45,46. The floats formed by MD yarns 45,46 and MD yarns 51,52 are offset in the machine direction from those formed by MD yarns 42,43 and MD yarns 48,49 by six CD yarns.

MD yarns 41,44,47,50, which separate the twinned MD yarn pairs from one another, weave over three CD yarns and under the following three CD yarns in a repeating pattern. Specifically, MD yarns 41,47 weave over CD yarns 21,22, 23, under CD yarns 24,25,26, over CD yarns 27,28,29, and under CD yarns 30,31,32 in each repeat of the weave pattern. On the other hand, MD yarns 44,50 weave over CD yarn 21, under CD yarns 22,23,24, over CD yarns 25,26,27, under CD yarns 28,29,30, and over CD yarns 31,32. As such, MD yarns 44,50 weave with the CD yarns in a manner that is offset in the machine direction from the manner in which MD yarns 41,47 so interweave by two CD yarns.

With particular reference to FIGS. 1 and 3A, it will be noted that MD yarn 41, and MD yarn 47 which weaves in the same manner, does not have a long float on the back-side surface 12 of fabric 10. Instead, MD yarns 41,47 weave over only CD yarns 22,28 of the second layer 16, and tend to pull CD yarns 22, 28 inwardly with respect to the back-side surface 12, so that the knuckles formed by MD yarns 41,47 when weaving with CD yarns 22,28 are inward of the floats formed by MD yarns 42,43; 45,46; 48,49; and 50,51. As a consequence, MD yarns 41,47 are protected from heat and abrasion on the back-side surface 12 of the fabric 10.

Similarly, MD yarn 44, and MD yarn 50 which weaves in the same manner, also does not have a long float on the back-side surface 12 of fabric 10. Instead, MD yarns 44,50 weave over only CD yarns 26,32 of the second layer 16, and tend to pull CD yarns 26,32 inwardly with respect to the back-side surface 12, so that the knuckles formed by MD yarns 44,50 when weaving with CD yarns 26,32 are also inward of the floats formed by MD yarns 42,43; 45,46; 48,49; and 50,51. As a consequence, MD yarns 44,50 are also protected from heat and abrasion on the back-side surface 12 of the fabric 10.

Because the knuckles formed when MD yarns 41,47 weave over CD yarns 22,28, and when MD yarns 44,50 weave over CD yarns 26,32 are inward of the long floats formed by MD yarns 42,43; 45,46; 48,49; 50,51, MD yarns 41,44,47,50 define continuous air channels 60 between these twinned pairs. Continuous air channels 60 provide a solution to the problem of "drop-off" in dryer sections such as single-run dryer sections. Continuous air channels 60, which are oriented in the machine direction, perform the same function as is carried out by grooved dryer rolls. That is, they provide volume for air carried into and trapped in a compression wedge, thereby reducing the tendency for air to be forced through the fabric 10 entirely, where it may cause "drop off". The void volume provided by continuous air channels 60 is different from that in other dryer fabric structures, both woven and spiral-link, because the void volume is continuous. Most dryer fabrics have some void volume, but generally the void volume is provided in discrete discontinuous pores or openings in the fabric. In the present invention, the void volume is continuous in a predetermined direction, such as in the machine direction.

Figure 2:
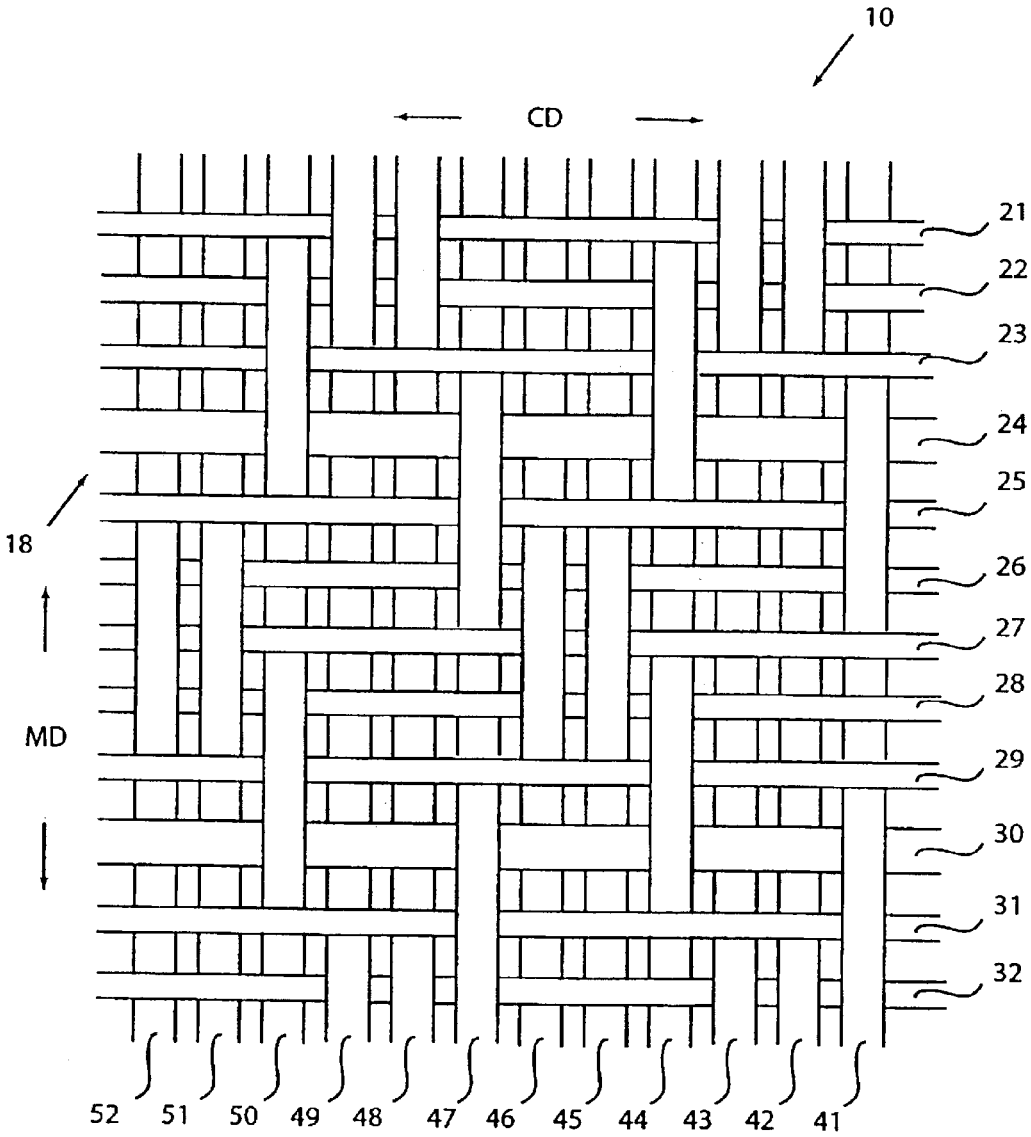
FIG. 2 is a plan view of the paper-contacting surface of the papermaker's fabric of FIG. 1.

FIG. 2 is a plan view of the paper-contacting surface 18 of the fabric 10, and is the reverse of FIG. 1. FIGS. 2 and 3A taken together show that MD yarns 41–52 bind with a single CD yarn 21,23,25,27,29,31 of the first layer 14 each time they weave to the first layer 14. Specifically, MD yarns 41,47 bind with CD yarns 25,31 as they weave to the first layer 14 twice in each repeat of the weave pattern. Similarly, MD yarns 44,50 bind with CD yarns 23,29 as they weave to the first layer 14 twice in each repeat of the weave pattern. On the other hand, the twinned pairs of MD yarns 42,43; 48,49 bind with CD yarn 21 as they weave to the first layer 14 once in each repeat of the weave pattern, while the twinned pairs of MD yarns 45,46; 51,52 bind with CD yarn 27 as they weave to the first layer 14 once in each repeat of the weave pattern. As a consequence, CD yarns 21,23,25, 27,29,31 make up most of the area of the paper-contacting surface 18 of the fabric, which surface 18 may appropriately be described as a shute-runner surface. In reality, CD yarns 22,24,26,28,30,32 of the second layer 16 may barely be visible on the paper-contacting surface 18 of the actual fabric 10 as the spacing between the yarns is quite small. In any event, the CD yarn-dominated nature of the paper-contacting surface 18 of the fabric 10 protects MD yarns 41–52 from heat and abrasion.

As an alternative to the arrangement previously described, the CD and MD yarns could be arranged so as to form a so-called monoplane surface wherein the CD and MD yarns both form the paper-contacting surface. Such monoplane surface arrangement would not affect the air channels.

Figure 3B:
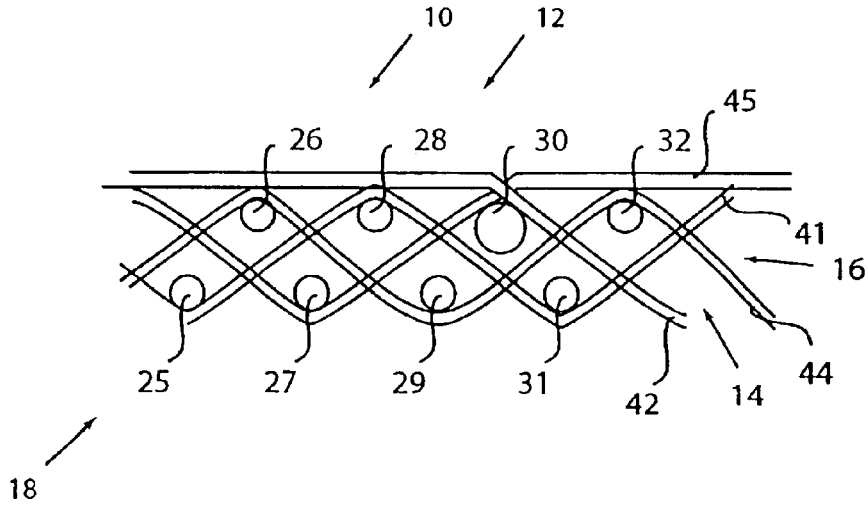
FIG. 3B is a cross-sectional view of a papermaker's fabric according to another embodiment of the present invention.

The fabric 10 preferably comprises only monofilament yarns. Specifically, the CD yarns may be anticontaminant polyester monofilament. Such anticontaminant may be more deformable than standard polyester and, as a result, may more easily enable the fabric to be woven so as to have a relatively low permeability (such as 100 CFM) as compared to the more non-deformable yarns. The CD yarns may have a circular cross-sectional shape with one or more different diameters. For example, CD yarns 24,30 may have a diameter of 0.90 mm while CD yarns 21–23, 25–29,31,32 may have a diameter of 0.50 mm or 0.60 mm. That is, CD yarns 24,30 may be of larger diameter than the other CD yarns 21–23, 25–29, 31,32 as suggested in FIGS. 1, 2, 3A, and 4. As twinned pairs of MD yarns 42,43; 45,46; 48,49; and 51,52 weave over CD yarns 24,30 when weaving up from or down to CD yarns 21,27 in the first layer 14, the larger diameter of CD yarns 24,30 provides additional depth to the continuous air channels 60. Alternatively, and as shown in FIG. 3B, all of the CD yarns (i.e. CD yarns 21–32) may each have the same diameter such as 0.80 mm. The MD yarns 41–52 may be flat monofilament yarns of substantially rectangular cross-sectional shape. For example, the MD yarns 41–52 may have substantially rectangular cross sections which measure 0.44 mm by 0.88 mm, the longer dimension lying parallel to the plane of the back-side surface as shown in FIG. 4.

The fabric 10 may be woven in a 6-harness repeat, although, in an alternate embodiment, it may be woven in a 4-harness repeat using single MD yarns of greater width in place of the twinned pairs of MD yarns shown in the figures.

CD yarns 21–32 may be monofilament yarns of circular cross section of any of the synthetic polymeric resins used in the production of such yarns for paper machine clothing. Polyester and polyamide are but two examples of such materials. Other examples of such materials are polyphenylene sulfide (PPS), which is commercially available under the name RYTON®, and a modified heat-, hydrolysis- and contaminant-resistant polyester of the variety disclosed in commonly assigned U.S. Pat. No. 5,169,499, and used in dryer fabrics sold by Albany International Corp. under the trademark THERMONETICS®. The teachings of U.S. Pat. No. 5,169,499 are incorporated herein by reference. Further, such materials as poly (cyclohexanedimethylene terephthalate-isophthalate) (PCTA), polyetheretherketone (PEEK) and others could also be used.

Further, in addition to a circular cross-sectional shape, one or more of the CD yarns may have other cross-sectional shapes such as a rectangular cross-sectional shape or a non-round cross-sectional shape.

As previously indicated, MD yarns 41–52 may be flat monofilament yarns of substantially rectangular cross-sectional shape. Alternatively, any or all of such MD yarns may have other cross-sectional shapes such as a circular cross-sectional shape or a non-round cross-sectional shape. Additionally, MD yarns 41–52 may be of any of the synthetic polymeric resins used in the production of yarns for paper machine clothing. Polyester and polyamide are but two examples, along with the other materials disclosed above.

Figure 5:
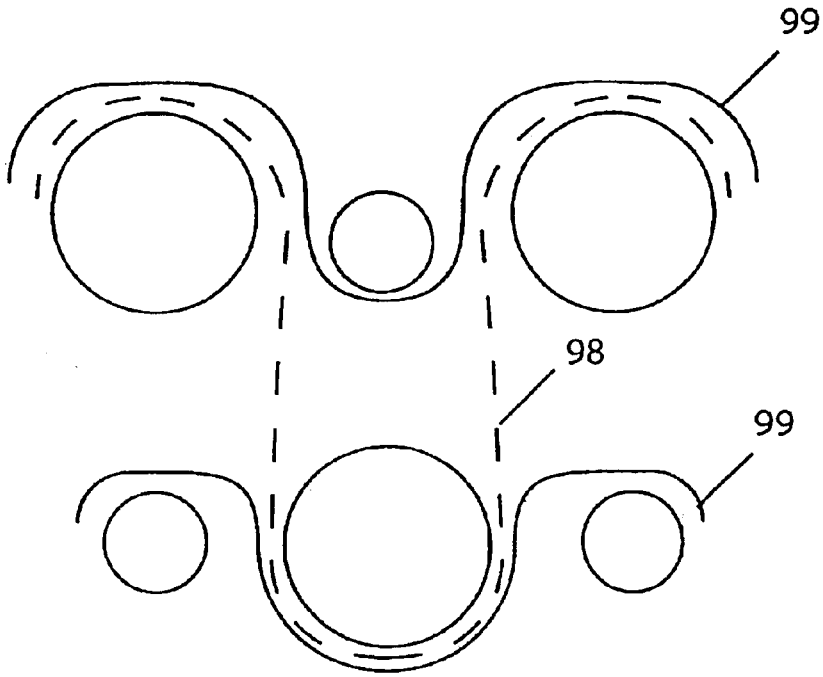
FIG. 5 is a cross-sectional view of a dryer section.
Figure 6:
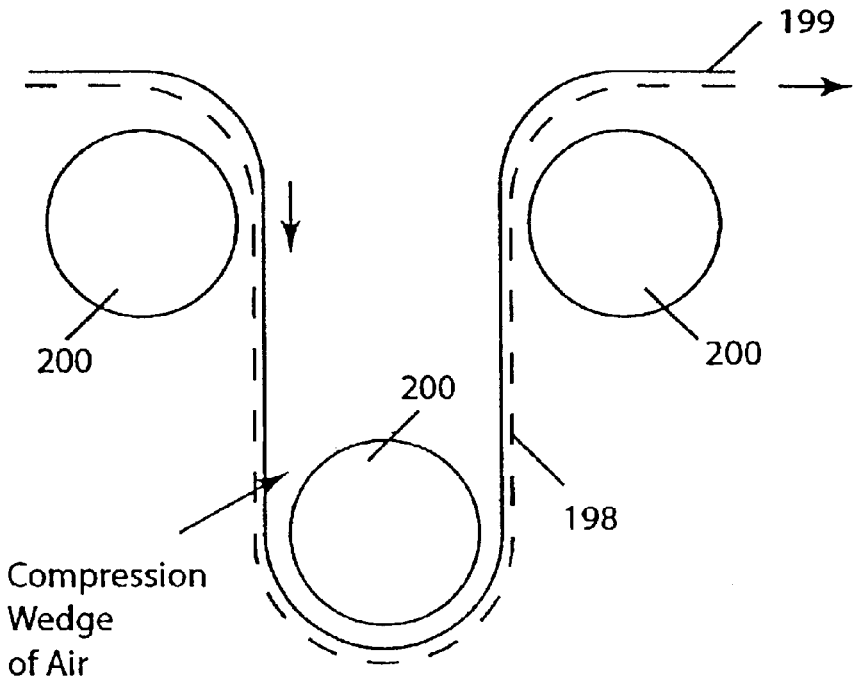
FIG. 6 is a cross-sectional view of a single-run dryer section.

The fabric 10 may be used with a single run or single tier dryer section. Alternatively, the fabric 10 may be used with other types of dryer sections, such as that shown in FIG. 5. As is to be appreciated, in such situation, fabrics 99 would be replaced with fabrics 10.

Modifications to the above would be obvious to those of ordinary skill in the art, but would not bring the invention so modified beyond the scope of the present invention. For example, while fabric 10 is typically flat-woven, and must be joined into endless form for use on the dryer section of a paper machine, it is also possible to produce the fabric 10 by endless weaving, in which case the MD yarns 41–52 would be weft yarns during the weaving process and the CD yarns 21–32 would be warp yarns. The claims to follow should be construed to cover such a situation.

What is claimed is:

1. A papermaker's fabric comprising:

a first layer and a second layer of cross-machine direction (CD) yarns; and a system of machine-direction (MD) yarns, said MD yarns being in groups of at least two adjacent MD yarns, each said group having a first MD yarn and at least one second MD yarn;

wherein said first MD yarn in each said group is interwoven with said CD yarns of said first and second layers in a duplex weave, said first MD yarn binding with only one CD yarn of said first layer and with only one CD yarn of said second layer when interweaving therewith;

wherein said second MD yarn in each said group is also interwoven with said CD yarns of said first and second layers in a duplex weave, said second MD yarn binding with only one CD yarn of said first layer when interweaving therewith and floating over at least two consecutive CD yarns of said second layer when interweaving therewith; and wherein said first MD yarn in each said group is between said at least one second MD yarn thereof and a second MD yarn of an adjacent group, whereby continuous air channels are formed on a back-side of the fabric by said first MD yarns between said second MD yarns.

2. A papermaker's fabric as claimed in claim 1 wherein said at least one second MD yarn is two second MD yarns, said two second MD yarns being a twinned pair interweaving side by side as one yarn with said CD yarns of said first and second layers.

3. A papermaker's fabric as claimed in claim 1 wherein said MD yarns are flat monofilament yarns of substantially rectangular cross-sectional shape.

4. A papermaker's fabric as claimed in claim 3 wherein said MD yarns are monofilament yarns having non-round cross-sectional shape.

5. A papermaker's fabric as claimed in claim 3 wherein at least some of said MD yarns are one of polyamide yarns, polyester yarns, polyphenylene sulfide yarns, modified heat-, hydrolysis- and contaminant-resistant polyester yarns, poly(cyclohexanedimethylene terephthalateisophthalate) yarns, and polyetheretherketone yarns.

6. A papermaker's fabric as claimed in claim 1 wherein said CD yarns are monofilament yarns of circular cross-sectional shape.

7. A papermaker's fabric as claimed in claim 6 wherein some of said CD yarns of said second layer are of larger diameter than the rest of said CD yarns in said first and second layers.

8. A papermaker's fabric as claimed in claim 6 wherein at least some of said CD yarns are polyamide yarns, polyester yarns, polyphenylene sulfide yarns, modified heat-, hydrolysis- and contaminant-resistant polyester yarns, poly (cyclohexanedimethylene terephthalateisophthalate) yarns, and polyetheretherketone yarns.

9. A papermaker's fabric as claimed in claim 1 wherein said CD yarns of said first layer are offset in the machine direction relative to said CD yarns of said second layer so as not to be in vertically stacked positions relative thereto.

10. A papermaker's fabric as claimed in claim 1 wherein said second MD yarn in each said group floats over four consecutive CD yarns of said second layer when interweaving therewith.

11. A papermaker's fabric as claimed in claim 1 wherein at least some of said CD yarns are monofilament yarns of non-round cross-sectional shape.

* * * * *